US007351106B2

(12) United States Patent
Zhu et al.

(10) Patent No.: US 7,351,106 B2
(45) Date of Patent: Apr. 1, 2008

(54) ELECTRICAL CONNECTOR HAVING AN INNER PRINTED CIRCUIT BOARD

(75) Inventors: Zi-Qiang Zhu, Kunshan (CN); Guo-Hua Zhang, Kunshan (CN); Jin-Kui Hu, Kunshan (CN); Feng Wan, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/525,750

(22) Filed: Sep. 22, 2006

(65) Prior Publication Data

US 2007/0066141 A1 Mar. 22, 2007

(30) Foreign Application Priority Data

Sep. 22, 2005 (CN) ..... 2005 2 0075848 U

(51) Int. Cl.
*H01R 13/648* (2006.01)

(52) U.S. Cl. ..... 439/607; 439/377

(58) Field of Classification Search ..... 439/76.1, 439/607, 676, 83, 876, 941, 79, 638, 541.5, 439/620, 620.06, 620.15, 620.22, 608–610, 439/377, 59, 75, 654

See application file for complete search history.

(56) References Cited

U.S. PATENT DOCUMENTS 6,174,198 B1 * 1/2001 Wu et al. ..... 439/541.5
6,364,713 B1 * 4/2002 Kuo ..... 439/638
6,450,837 B1 * 9/2002 Givens et al. ..... 439/620.19
6,623,306 B2 9/2003 Xu et al.
6,685,486 B1 2/2004 Zhang et al.
6,786,772 B1 * 9/2004 Liu ..... 439/620.06

* cited by examiner

*Primary Examiner*—Edwin A. Leon
(74) *Attorney, Agent, or Firm*—Wei Te Chung

(57) ABSTRACT

An electrical connector (100) for mounting on an external printed circuit board comprises an insulative housing (20) having a front mating face, a mounting face, a plurality of passageways (216) extending rearwardly from the mating face, a receiving cavity (213) extending through the mounting face and communicating with the passageways; an inner module (30) received in the receiving cavity and including a front contact module (31) having a front insulative block (313) and a plurality of front contacts (301) mounted thereon and extending into corresponding passageways, a rear contact module (32) having a rear insulative block (323) and a plurality of rear contacts (302) mounted thereon and extending beyond the mounting face for being mounted on the external printed board, and an inner printed circuit board (304) sandwiched between the front insulative block and the rear insulative block and electrically connecting the front contacts with the rear contacts.

13 Claims, 5 Drawing Sheets

ELECTRICAL CONNECTOR HAVING AN INNER PRINTED CIRCUIT BOARD

BACKGROUND OF THE INVENTION

1. Field of the Invention

The present invention relates to an electrical connector and more particularly to an electrical connector having an inner printed circuit board.

2. Description of Related Art

A Digital Visual Interface (DVI) connector disclosed in U.S. Pat. No. 6,685,486 comprises an insulative housing, a plurality of contact modules extending in the insertion direction of a mating connector and fixed to the housing, and a spacer for aligning contacts of the contact modules and facilitating mounting the connector onto a printed circuit board. Generally, more and more electrical connectors have standard mating faces for engaging with standard mating connector manufactured by different manufacturer, while the overall lengthwise dimension of the electrical connectors may be changed due to requirements of the environment where the electrical connectors are mounted. However, the conventional connector design need to change different molds for electrical connectors of different length, thus it is difficult to decrease manufacturing cost.

It is thus desired to provide an electrical connector to overcome the shortcomings described above.

SUMMARY OF THE INVENTION

An object of the present invention is to provide electrical connectors having similar structures with different length and low manufacturing cost.

Another object of the present invention is to provide an electrical connector for fixing an inner printed circuit boards therein reliably.

In order to achieve above-mentioned object, an electrical connector for mounting on an external printed circuit board comprises an insulative housing having a front mating face, a mounting face, a plurality of passageways, a receiving cavity extending through the mounting face and communicating with the passageways; an inner module received in the receiving cavity and including a front contact module having a front insulative block and a plurality of front contacts mounted thereon and extending into corresponding passageways, a rear contact module having a rear insulative block and a plurality of rear contacts mounted thereon and extending beyond the mounting face for being mounted on the external printed board, and an inner printed circuit board sandwiched between the front insulative block and the rear insulative block and electrically connecting the front contacts with the rear contacts.

Other objects, advantages and novel features of the present invention will become more apparent from the following detailed description of the present embodiment when taken in conjunction with the accompanying drawings.

DETAILED DESCRIPTION OF THE INVENTION

Figure 1:
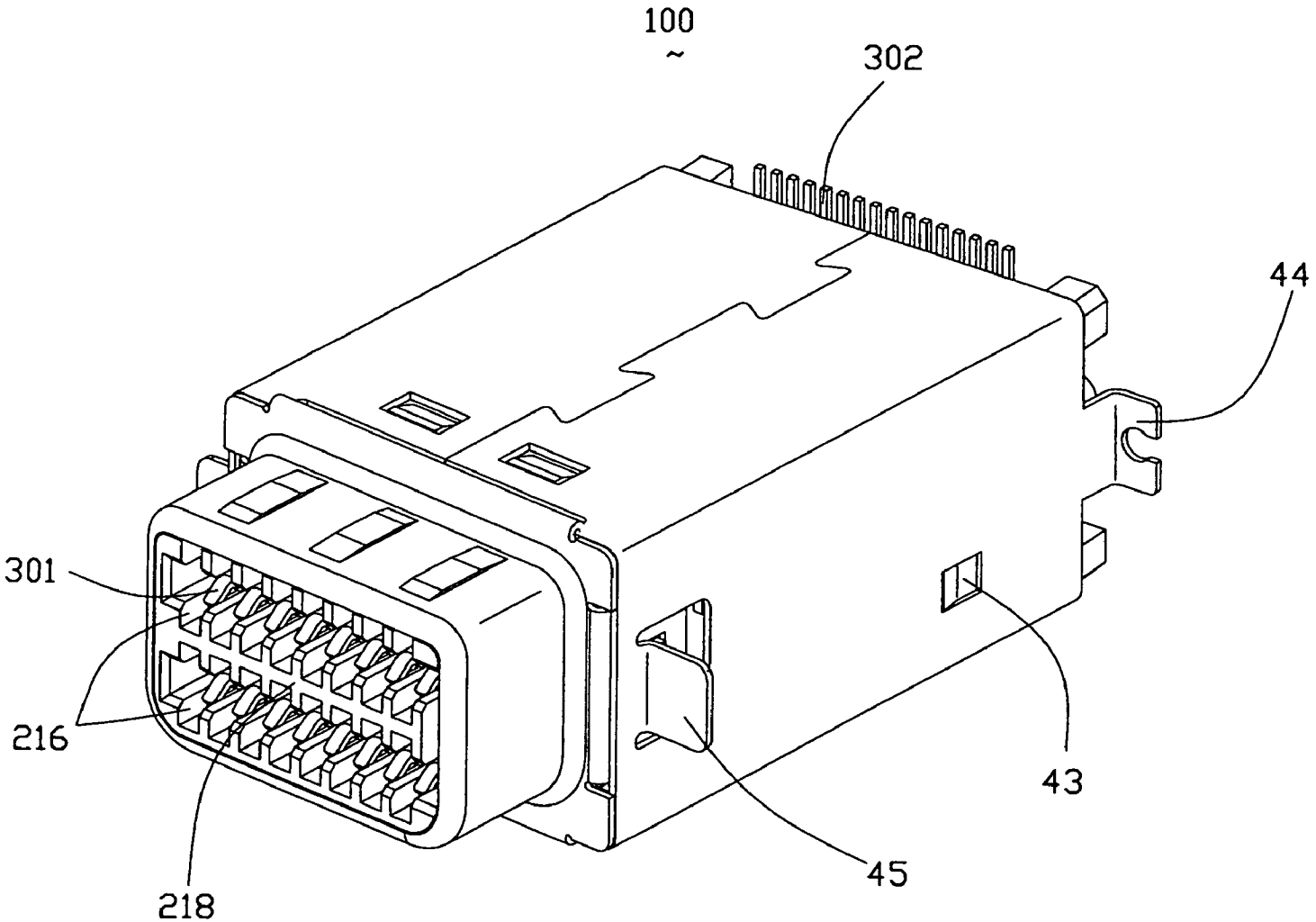
FIG. 1 is an assembled perspective view of an electrical connector according to the present invention.

Reference will now be made to the drawing figures to describe the preferred embodiment of the present invention in detail.

Figure 2:
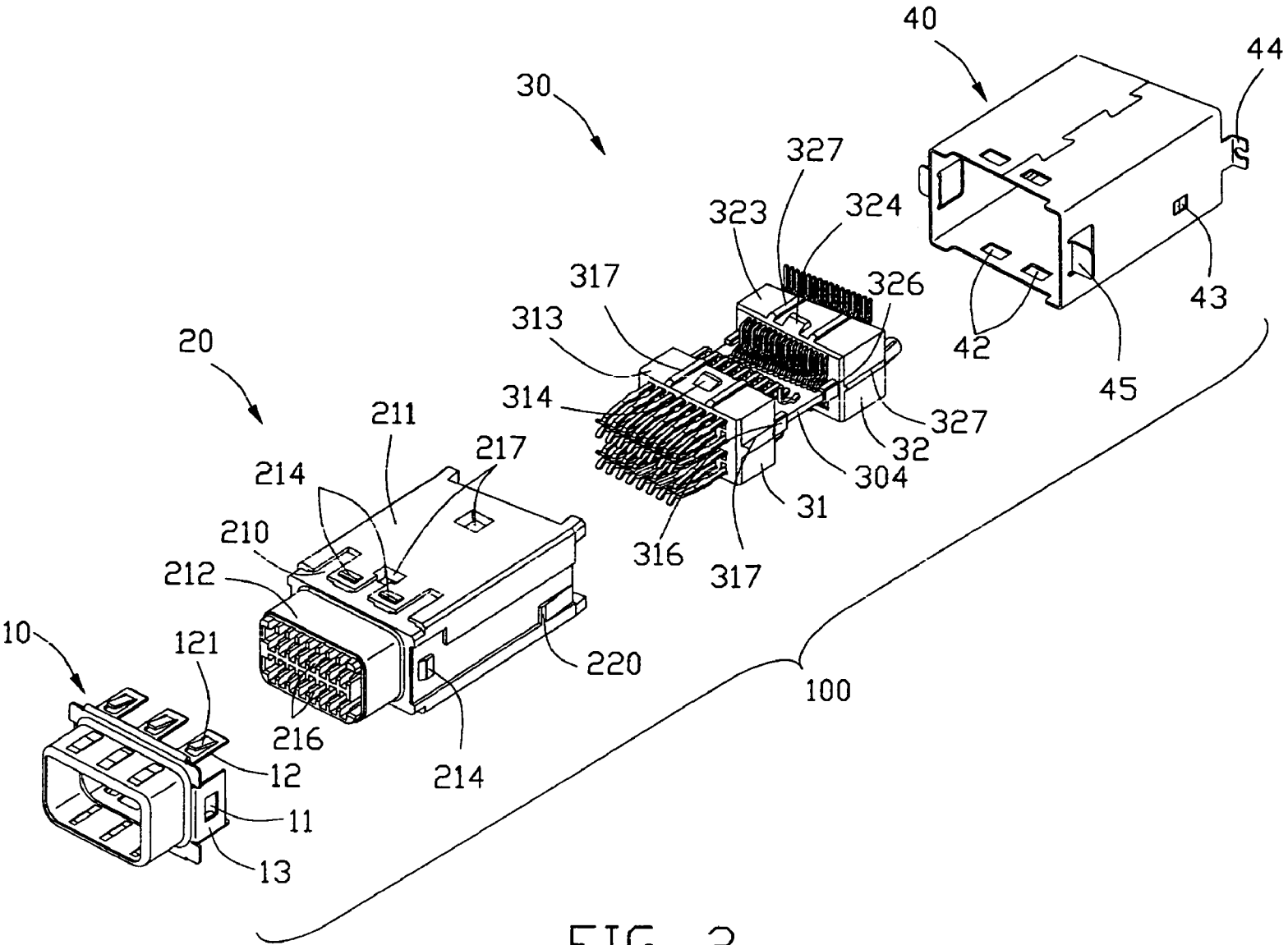
FIG. 2 is an exploded perspective view of the electrical connector of FIG. 1.
Figure 3:
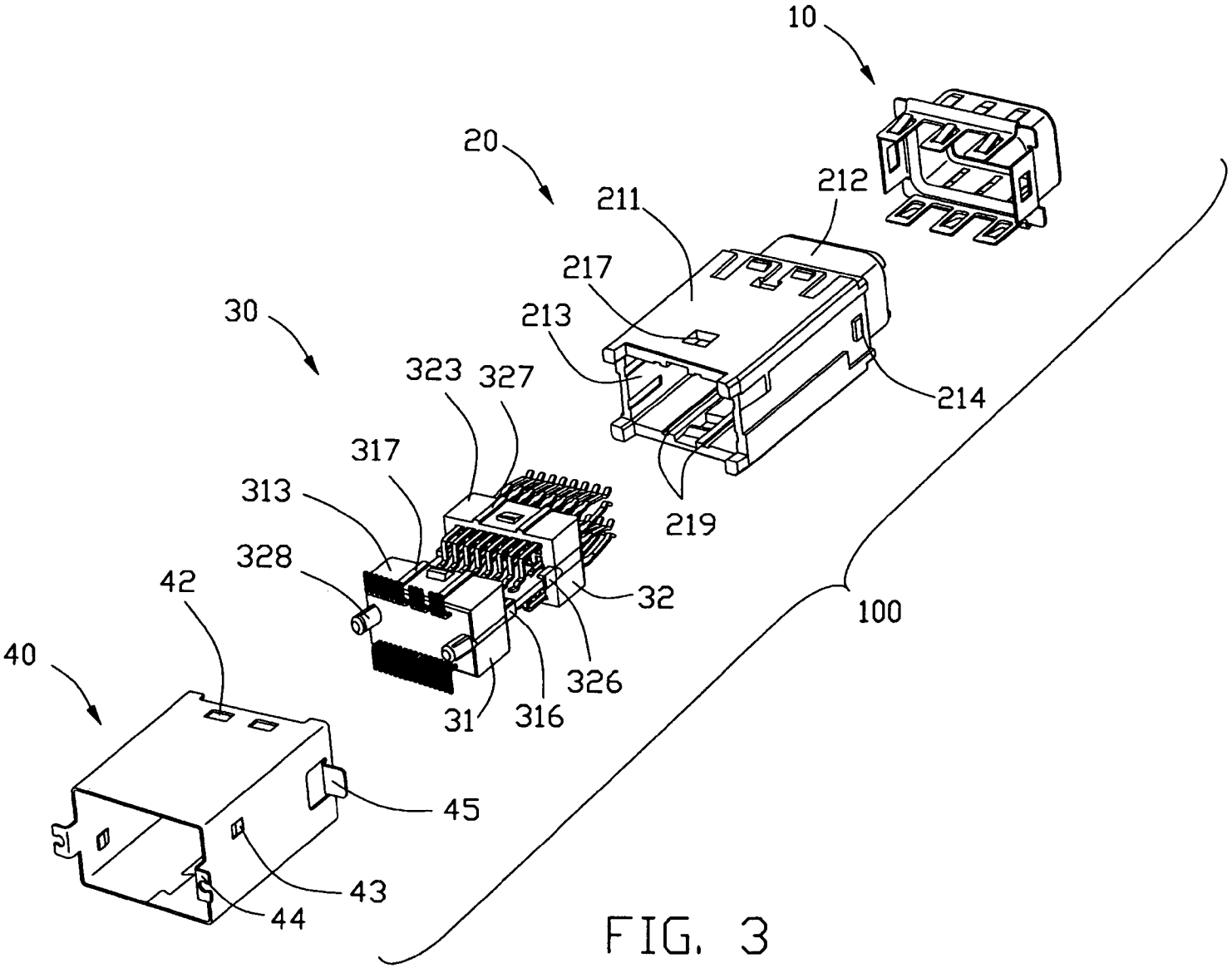
FIG. 3 is another exploded perspective view similar to FIG. 2, while taken from a different aspect.
Figure 4:
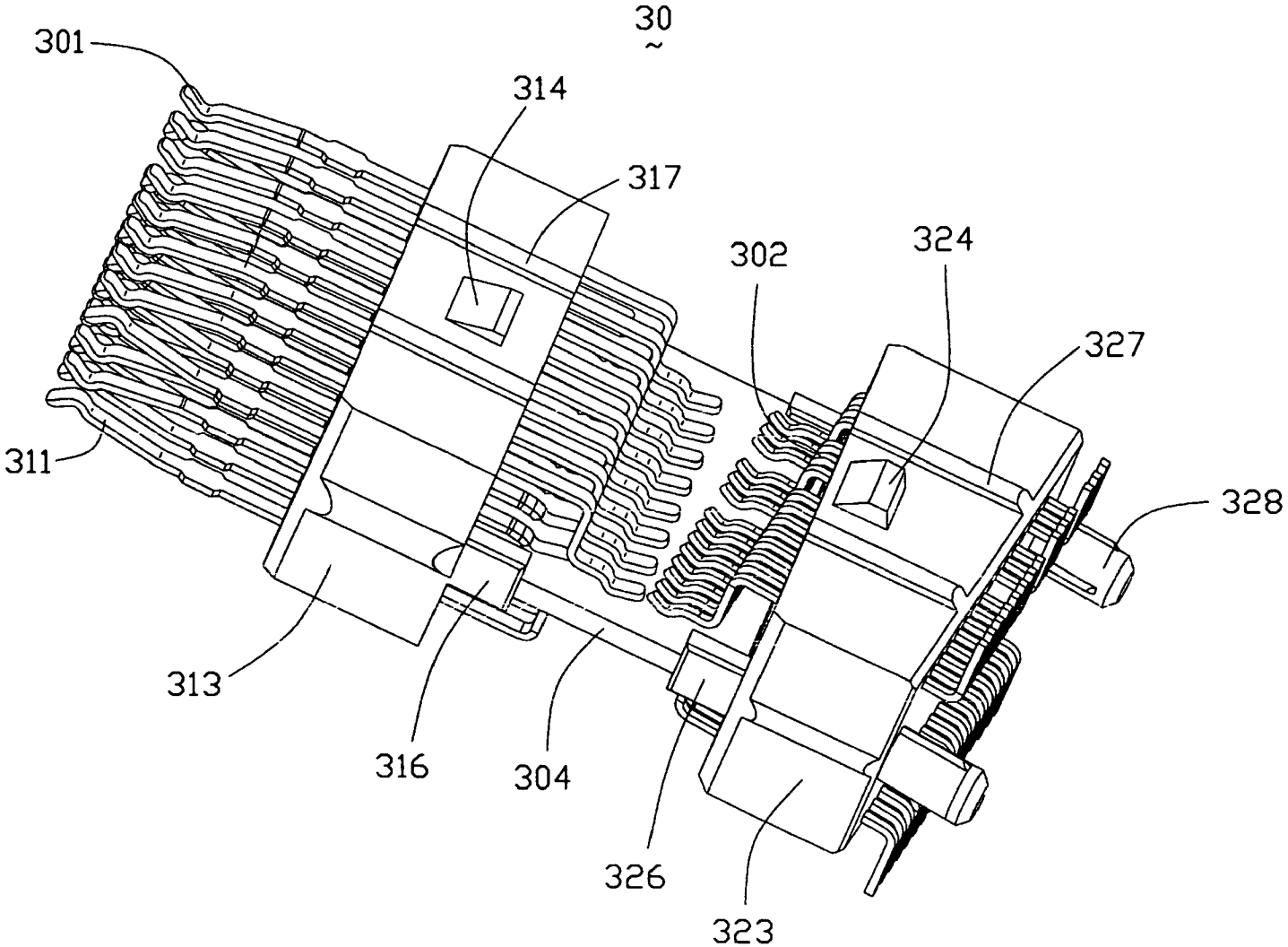
FIG. 4 is an assembled perspective view of an inner module shown in FIG. 2.
Figure 5:
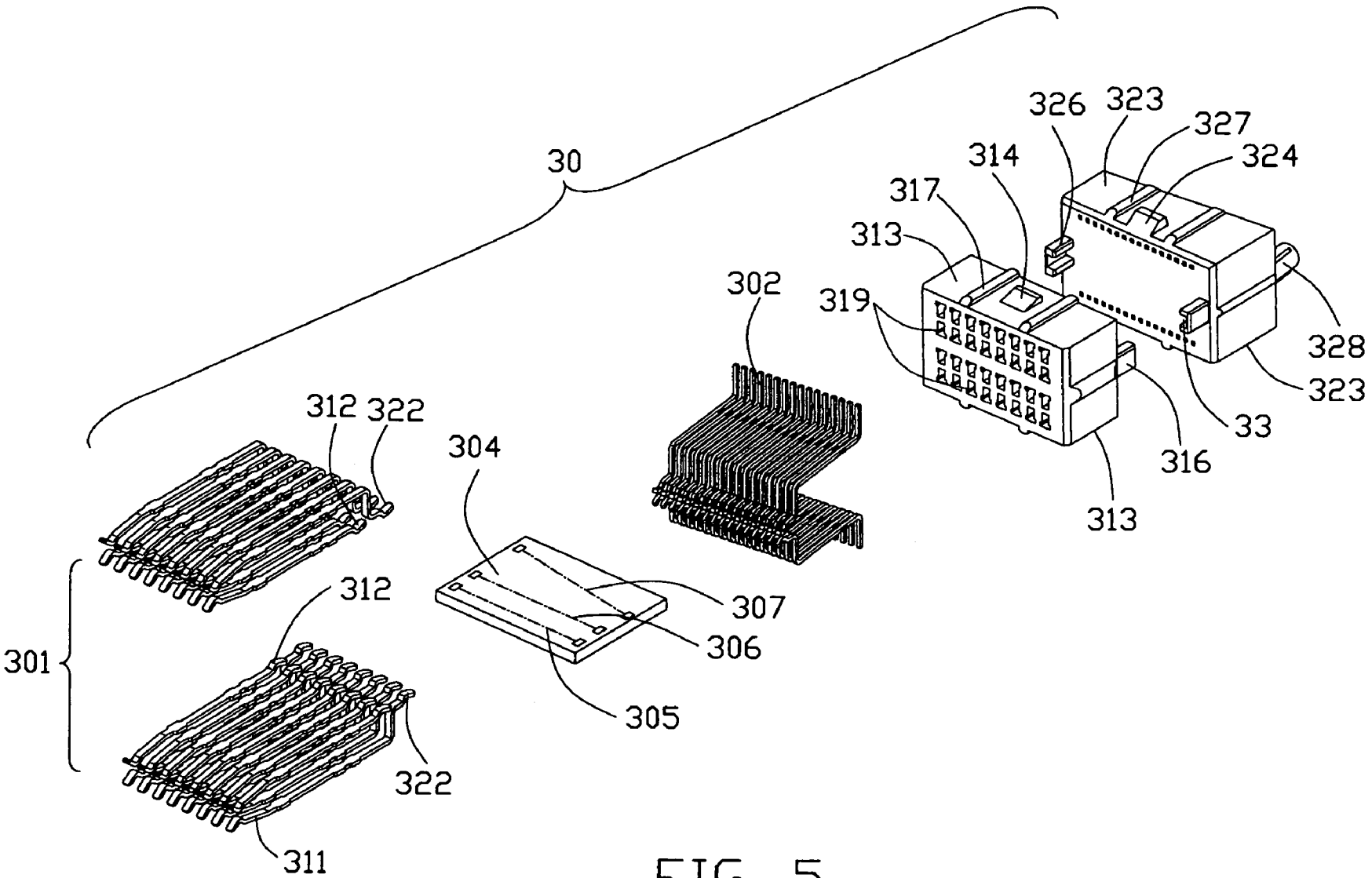
FIG. 5 is an exploded perspective view of the inner module.

Referring to FIGS. 1, 2 and 3, an electrical connector 100 in the preferred embodiment is a mini Digital Visual Interface (DVI) connector adapted to interconnect a display device and a computer mainframe. The electrical connector 100 is mounted on an external printed circuit board (not shown) to mate with a complementary connector, comprises an elongated insulative housing 20, a front shell 10 and a rear shell 40 commonly enclosing the housing 20, an inner module 30 received in the housing 20.

The housing 20 includes a rectangular base portion 211 defining a rear mounting face, a mating portion 212 extending forwardly from the base potion 211, and a receiving cavity 213 extending through the mounting face for accommodating the inner module 30. Wherein the mating portion 212 defines a front mating face angled to the mounting face, and a tongue portion 218 extending rearwardly from a substantially middle portion thereof. A plurality of contact-receiving passageways 216 are provided on opposite sides of the tongue portion 218 and opposite inside walls of the mating portion 212, said passageways 216 extend in a front-to-rear direction and communicating with the receiving cavity 213. A number of embossments 214 project outwardly from side walls of the base portion 211 for interferentially engaging with corresponding locking holes 11, 42 formed on the front shell 10 and the rear shell 40 respectively.

The front shell 10 covers the mating portion 212 of the housing 20, includes a plurality of latches 12 extending rearwardly from an upper edge and a lower edge thereof and a pair of lateral flanges 13 with the locking holes 11 formed thereon. A number of slots 210 are provided in a top wall and a bottom wall of the base portion 211 for fixing corresponding latches 12 therein. Each of the latches 12 has a spring arm 121 protruding upwardly for abutting against side walls of the rear shell 40.

The rear shell 40 covers the base portion 211 of the housing 20, has a pair of solder pads 44 extending laterally from bottom edges thereof for surface mounting on the external printed circuit board and a pair of projections 43 protruding inwardly from side walls thereof. Upon assembling the rear shell 40 to the housing 20, said projections 43 slide along inclined tabs 220 formed on side walls of the base portion 211 and finally latch with an inner side face of the inclined tabs 220. A pair of ear portions 45 extend laterally and outwardly from front end of the rear shell 40 for mating with outer panel (not shown).

The inner module 30 includes an inner printed circuit board 304 extending along a lengthwise direction of the housing 20, a front contact module 31 mounted on a front end of the inner printed circuit board 304 and a rear contact module 32 mounted on a rear end of the inner printed circuit board 304 and electrically connected to the front contact module 31. Said front contact module 31 includes a front insulative block 313 having a plurality of contact passageways 319, a plurality of front contacts 301 retained in the corresponding passageways 319 and arranged in four rows along a direction perpendicular to the insertion direction of the mating connector. The front contacts 301 each comprises a contacting portion 311 extending into a corresponding passageway 216 of the housing 20 and a mounting portion, wherein mounting portions 312 of the front contacts 301 arranged in the second row and the third row are surface mounted to front circuit traces 305 on opposite side surfaces of the inner printed circuit board 304 respectively, and mounting portions 322 of the first row and the four row are surface mounted to middle circuit traces 306 adjacent to the front circuit traces 305.

The rear contact module 32 comprises a rear insulative block 323 and a plurality of rear contacts 302 integrally molded with the rear insulative block 323 and surface mounted onto the external printed circuit board. Said rear contacts 302 are arranged in an upper row and a lower row which are surface mounted to rear circuit traces 307 on opposite sides of the rear end of the inner printed circuit board 304. A pair of inclined posts 328 inclinedly extends from a rear end of the rear insulative block 323 relative to the rear mounting face for mounting in appropriate mounting holes in the external printed circuit board.

A plurality of ribs 317, 327 are provided on side faces of both the front insulative block 313 and the rear insulative block 323, said ribs 317, 327 are guided into corresponding elongated slots 219 provided on inside walls of the housing 20 during insertion the inner module 30 into the housing 20. A ramped latch boss 314, 324 is formed on an upper face of both the front insulative block 313 and the rear insulative block 323 for interferentially engaging with locking holes 217 formed on the base portion 211 of the housing 20. A pair of protrusions 316, 326 extend from a rear end of the front insulative block 313 and a front end of the rear insulative block 323 respectively. An elongated groove 33 is defined in an inner side of each protrusion 316, 326. Opposite side edges of the inner circuit board 304 are inserted into opposite grooves 33 of the front insulative block 313 and the rear insulative block 323 and supported by the front insulative block 313 and the rear insulative block 323, thereby fixing the inner circuit board 304 reliably and ensuring electrical connection between the front contacts 301 and the rear contacts 302. It should be noted that inner printed circuit board 304 of different lengths can be sandwiched between the front insulative block 313 and the rear insulative block 323, therefore electrical connectors 100 of different lengths can be manufactured by varying the inner printed circuit board 304 and reusing the molds for making the front contact module 31 and the rear contact module 32.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mounted on an external printed circuit board and mating with a complementary connector, comprising: an insulative housing defining a front mating face extending in a first direction and a mounting face, a receiving cavity and a plurality of passageways extending rearwardly from the mating face and communicating with the receiving cavity;

an inner module received in the receiving cavity, comprising:

an inner printed circuit board extending along a lengthwise direction of the housing perpendicular to the first direction;

a front contact module mounted on a front end of the inner printed circuit board, the front contact module having a front insulative block and a plurality of front contacts mounted thereon and extending into corresponding passageways;

a rear contact module mounted on a rear end of the inner printed circuit board and electrically connected to the front contact module, the rear contact module having a rear insulative block and a plurality of rear contacts fixed on the rear insulative block mounted on both the inner printed circuit board and the external printed circuit board, a pair of protrusions extending from a rear end of the front insulative block and a front end of the rear insulative block, respectively, an elongated groove being defined in an inner side of each protrusion, opposite side edges of the inner circuit board are inserted into opposite grooves of the front insulative block and the rear insulative block and supported by the front insulative block and the rear insulative block, thereby fixing the inner circuit board reliably and ensuring electrical connection between the front contacts and the rear contacts.

2. The electrical connector as claimed in claim 1, wherein the front insulative block and the rear insulative block each has a rib for insertion into an elongated slot provided on inside walls of the housing.

3. The electrical connector as claimed in claim 1, wherein both the front contacts and the rear contacts are surface mounted on the inner printed circuit board, the front contact comprise a first row contact elements, a second row contact elements positioned behind the first row contact elements, a third row contact elements and a fourth row contact elements positioned behind the third row contact elements, the first row contact elements and the second row contact elements are soldered onto an upper face of the inner printed circuit board respectively, the third row contact elements and the fourth row contact elements are soldered onto an lower face of the inner printed circuit board respectively, the rear contacts are arranged in two rows to be mounted onto an upper and a lower face of the inner printed circuit board respectively.

4. The electrical connector as claimed in claim 1, wherein the inner module has a ramped latch boss for interferentially engaging with a locking hole formed on the insulative housing.

5. The electrical connector as claimed in claim 1, wherein the housing includes a rectangular base portion and a mating portion extending forwardly therefrom, the mating face and the mounting face are formed on the mating portion and the base portion respectively.

6. The electrical connector as claimed in claim 5, wherein the mating portion has a tongue portion extending rearwardly from the mating face, the passageways are formed on inside wall of the mating portion and the tongue portion and arranged in four rows.

7. The electrical connector as claimed, in claim 5, wherein the rear insulative block has a post extending inclinedly from a rear end thereof for mounting on the external printed circuit board.

8. The electrical connector as claimed in claim 5, further comprising a front shell and a rear shell attached to the mating portion and the base portion respectively to enclose the housing.

9. An electrical connector mounted on an external printed circuit board, comprising:

an insulative housing having a front mating face extending in a first direction, a mounting face, and a receiving cavity extending through the mounting face;

an inner module received in the receiving cavity, comprising:

a front contact module having a front insulative block defining a first insulative groove and a plurality of front contacts mounted thereon;

a rear contact module having a rear insulative block defining a second elongated groove and a plurality of rear contacts mounted thereon and extending beyond the mounting face for being mounted on the external printed board; and an inner printed circuit board extending along a lengthwise direction of the housing perpendicular to the first direction and inserted into both the first elongated groove and the second elongated groove to be fixed between the front insulative block and the rear insulative block, a pair of protrusions extending from a rear end of the front insulative block and a front end of the rear insulative block, respectively, said first and second elongated grooves being defined in an inner side of each protrusion, opposite side edges of the inner circuit board are inserted into opposite grooves of the front insulative block and the rear insulative block and supported by the front insulative block and the rear insulative block, thereby fixing the inner circuit board reliably and ensuring electrical connection between the front contacts and the rear contacts.

10. An electrical connector mounted on an external printed circuit board, comprising:

an insulative housing having a front mating face, a mounting face, and a receiving cavity extending through the mounting face;

an inner module received in the receiving cavity, comprising:

a front contact module having a front insulative block with a plurality of front contacts mounted thereon;

a rear contact module having a rear insulative block with a plurality of rear contacts mounted thereon and extending beyond the mounting face for being mounted on the external printed circuit board; and an inner printed circuit board located between the front insulative block and the rear insulative block and electrically connecting the front contacts with the rear contacts; wherein the front contacts extend along a first direction in a top view, the rear contacts extend along a second direction in said top view under a condition that said first direction is oblique to said second direction in said top view; wherein the mating face is oblique to the mounting face in said top view under a condition that the mating face is essentially perpendicular to the first direction, and the mounting face is essentially perpendicular to the second direction.

11. The electrical connector as claimed in claim 10, wherein rear portions of the front contacts commonly define a first connection area extending in a third direction, and front portions of the rear contacts commonly define a second connection area extend in a fourth direction oblique to said third direction.

12. The electrical connector as claimed in claim 10, wherein the rear block defines a front edge which is oblique to a rear edge of the front block.

13. The electrical connector as claimed in claim 10, the rear block defines a front edge, and front portions of the rear contacts extend beyond said front edge and are exposed with different lengths, respectively.

* * * * *